United States Patent [19]

Kaufman

[11] Patent Number: 4,655,062

[45] **Date of Patent: * Apr. 7, 1987**

[54] SYSTEM OF INTERCONNECTED LOCK-CYLINDERS

[76] Inventor: Lazar Kaufman, 112 Centre St., #9F, Brookline, Mass. 02145

[ * ] Notice: The portion of the term of this patent subsequent to Jan. 7, 2003 has been disclaimed.

[21] Appl. No.: 456,865

[22] Filed: Jan. 10, 1983

[51] Int. Cl.[4] ..... E05B 35/12

[52] U.S. Cl. ..... 70/339; 70/380

[58] Field of Search ..... 70/337, 339, 379 R, 70/379 A, 380, 134, 124, 129

[56] References Cited

U.S. PATENT DOCUMENTS 474,783 5/1892 Taylor ..... 70/337

3,808,984 5/1974 Teleky ..... 70/339

FOREIGN PATENT DOCUMENTS 38397 2/1931 France ..... 70/339

*Primary Examiner*—Robert L. Wolfe

*Attorney, Agent, or Firm*—Amster, Rothstein & Ebenstein

[57] ABSTRACT

A locking system comprising a housing, first and second lock cylinders each including a disk having an extension, each of the disk being rotated by a suitable key, a thrust bar having notches to receive the extensions and having a locking position for which the extensions are engaged in the notches, the thrust bar being movable when the disks are rotated simultaneously so that the extensions move out of the notches, means to maintain the extensions in the notches when the thurst bar is in its locking position, and means to urge the thrust bar to its locking position.

3 Claims, 17 Drawing Figures

SYSTEM OF INTERCONNECTED LOCK-CYLINDERS

SUMMARY OF THE INVENTION

A system of interconnected lock-cylinders which are so connected with one another in their initial positions, that the rotation of each of them is dependent on the movement of the others.

This invention is a system which so connects several lock-cylinders so that the rotation of some of these cylinders, herein named "dependent" cylinders from their initial position is dependent on the movement of other of said cylinders, herein named "independent" cylinders. This system is intended for use in conjunction with new or with existing standard locks, which are already mounted on the door. This system is described in Ser. No. 097,402, registered Jan. 30, 1981.

In the description below are represented different variants of interconnecting cylinders. Some of them permit the rotation of the "dependent" cylinder from its initial position only together with other cylinders and some of them permit the rotation of the "dependent" cylinder only after the rotation of each of the independent cylinders through their predetermined angles.

The connection of several lock-cylinders is generally known from the U.S. Pat. No. 2,163,121, but the correct patent has the drawback that one can find out the selection of the correct key because of the increased clearance in the kinematic chain of said system when a right key is selected for the cylinder. In addition, the system could not be successfully applied to previously mounted locks.

Figure 1:
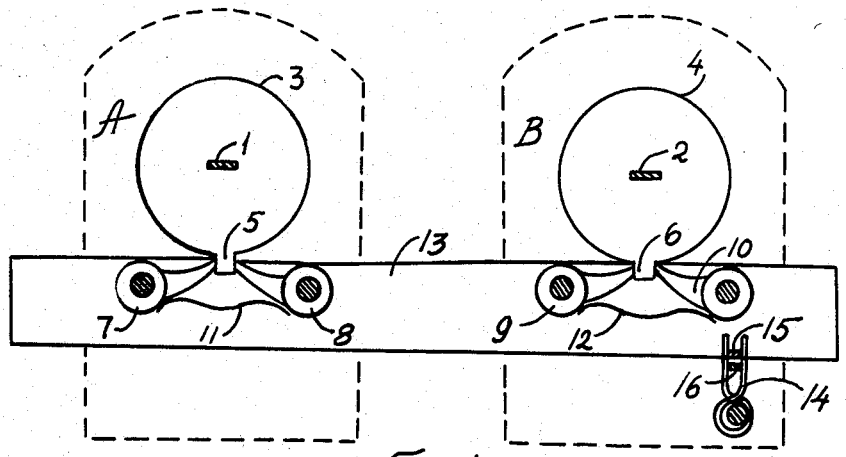
FIG. 1. A system for connecting the interconnected lock cylinders in their initial positions by means of disks and a rack with pawls.

FIG. 1 shows a variant of the instant invention, wherein the lock-cylinders A and B are connected by the connecting bars 1 and 2 with respective disks 3 and 4, which are provided by respective extensions 5 and 6. In the initial positions of these cylinders A and B each extension 5 and 6 is connected with a pair of the pawls 7 and 8 or 9 and 10, which are pressed by the springs 11 and 12 to the extensions 5 and 6. Said pawls 7, 8, 9, 10 and springs 11 and 12 are mounted on the same thrust bar 13. This device permits the rotation each of said cylinders A and B from its initial position only together combined with the longitudinal moving of the thrust bar 13 and with the rotation of other cylinder. When they reach eventually a certain angle, then automatically they reach the state of disengagement from the thrust bar 13, which independently returned to its initial position by the spring 14, which is supported by the bar-stop 15 and by the stop 16 of the lock-plate. Each of said cylinders A and B after its rotation, passes out said pawls and returns in its initial position. The thrust bar 13 slides in the grooves of the locks, or along the guides in the lock-plates for fixing said cylinders A and B to the door, or along the guides common plate for both these cylinders and their locks.

Figure 2:
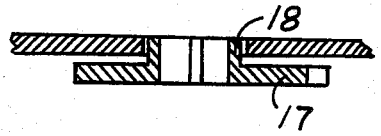
FIG. 2. A connection for the disks of the system with the connecting bars of the lock-cylinders.
Figure 2:
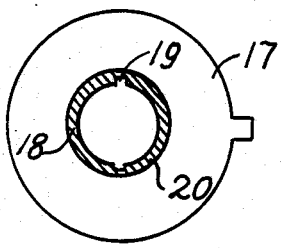

FIG. 2 shows a variant of the disk 17, wherein it is provided with a flange 18 and slots 19 for the adjustment this disk 17 with the lock. The flange 18 passes through the hole 20 in the cover of the device, or in the hole of the lock and this way adjusts the disk to the lock. The slots 19 are intended to accept the connecting bar of the cylinder which moves said disk.

Figure 3:
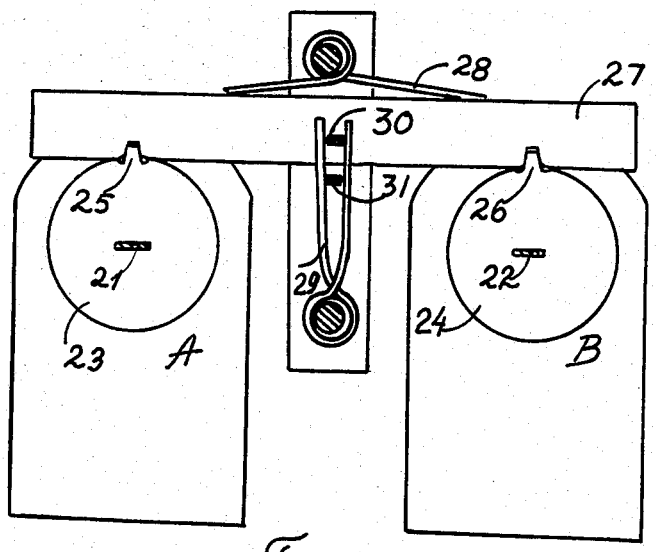
FIG. 3. A system for connecting the interdependent lock-cylinders in their initial positions by means of disks and a rack with tooth spaces.

FIG. 3 shows the invention of a device, wherein the lock-cylinders A and B are respective connected by the connecting bars 21 and 22 with respective disks 23 and 24 which provided with respective extensions 25 and 26. This device permits the rotation each of said cylinders A and B from its initial position only together with the longitudinal moving of the thrust bar 27 and with the rotation of other cylinder. When the cylinders A and B reach eventually a certain angle then they disengagemented from the thrust bar 27, which independently returned to its initial position due to the spring 29 which is supported by the bar-stop 30 and by the stop 31 of the device. Each of said cylinders A and B after its rotation releases the thrust bar 27, but again locks it due to the spring 28. The bodies of the interconnected locks are provided with grooves to receive and pass the thrust bar 27.

Figure 4:
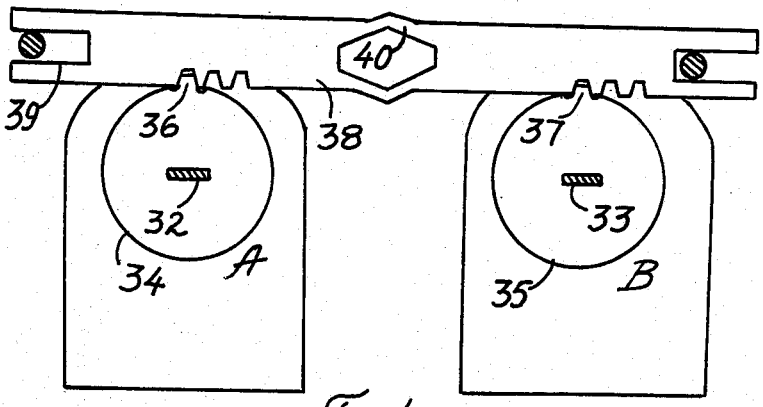
FIG. 4. A system for connecting the interdependent lock-cylinders in their initial positions by means of disks and a rack with three tooth spaces.

FIG. 4 shows a variant of the invention, wherein the lock-cylinders A and B are respective connected by the connecting bars 32 and 33 with respective disks 34 and 35, which are provided with respective extensions 36 and 37. In initial positions of these cylinders each extension 36, 37 is connected with the edge from several cavities of the thrust bar 38, which slides in its guides 39. This device permits the rotation each of said cylinders A and B from its initial position only in conbination with the longitudinal movement of the thrust bar 38 and with the rotation of other cylinder. When the cylinders A and B reach eventually a certain angle then they disengagemented from the thrust bar 38. Each of said cylinders A and B after its release rotated to a position in which the extension of its disk contact the opposite edge notch of the thrust bar 38 and then both of said cylinders A and B together with the thrust bar are returned to their initial positions. The thrust 38 is provided with a rhombic hole 40, which makes it possible to change the length of the thrust bar 38 stretching the opposite angles of said rhombic hole, and this way, to regulate the clearance in the kinematic chain between said connected cylinders A and B.

Figure 5:
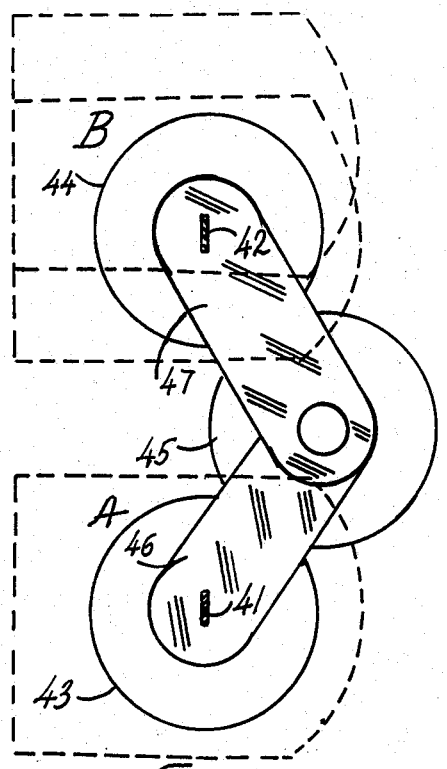
FIG. 5. A system for connecting the interdependent lock-cylinders by means of eccentric gears and rotating plates which provide the exact gearing of the lock-cylinders independent of the distance between them.

FIG. 5 shows a variant of the invention, wherein the lock-cylinders A and B are connected by the respective connecting bars 41 and 42 with respective gears 43 and 44, which are connected with an intermediate gear 45. The gear 45 is mounted on the plates 46 and 47, which are turned around the respective axis of gears 43 and 44. This way, the connection between both cylinders A and B is independent of the distance between said cylinders and provides for the rotation each of them only together with other. The teeth of the gears 43 and 44 are eccentric to the respective axis and each of said gears is mounted so, that in the initial position of one cylinder, each gear is connected with the intermediate gear 45 with a minimum clearance between them. This makes it impossible to determine the right key by touch because of the increased clearance in the kinematic chain of said system when a right key is selected to the cylinder.

Figure 6:
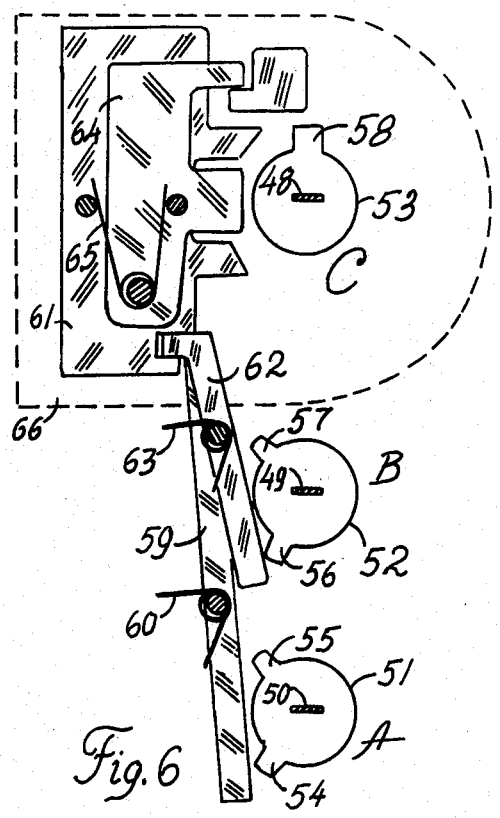
FIG. 6. A system of connection for the interdependent lock-cylinders in their initial positions for locking one lock-bolt.

FIG. 6 shows a variant of the invention, wherein the cylinders A, B, and C are connected by the respective connecting bars 48, 49, 50 with disks 51, 52, and 53, which are provided with shoulders 54, 55, 56, 57, and 58. The shoulders 54 and 55 interact with the lever 59, which locks and unlocks due to the spring 60 the bolt 61 of the lock when the cylinder A is rotated. The shoulders 56 and 57 interact with the lever 62 which locks due to the spring 63 and the same bolt 61, and moves this bolt for locking and unlocking the lock 66 when the cylinder C is rotated. Said disks 51, 52, and 53 are interconnected with one of the devices which is showed in FIGS. 1, 3, 4 and 5. For locking and unlocking the lock, it is enough to insert the right keys in said cylinders and to rotate only the key of the cylinder C, because at the same time, it will cause the rotating of the cylinders B and A to the angle which is necessary for their disengagement and which cause the unlocking of the bolt 61 and its moving for locking or unlocking the lock 66.

Figure 7:
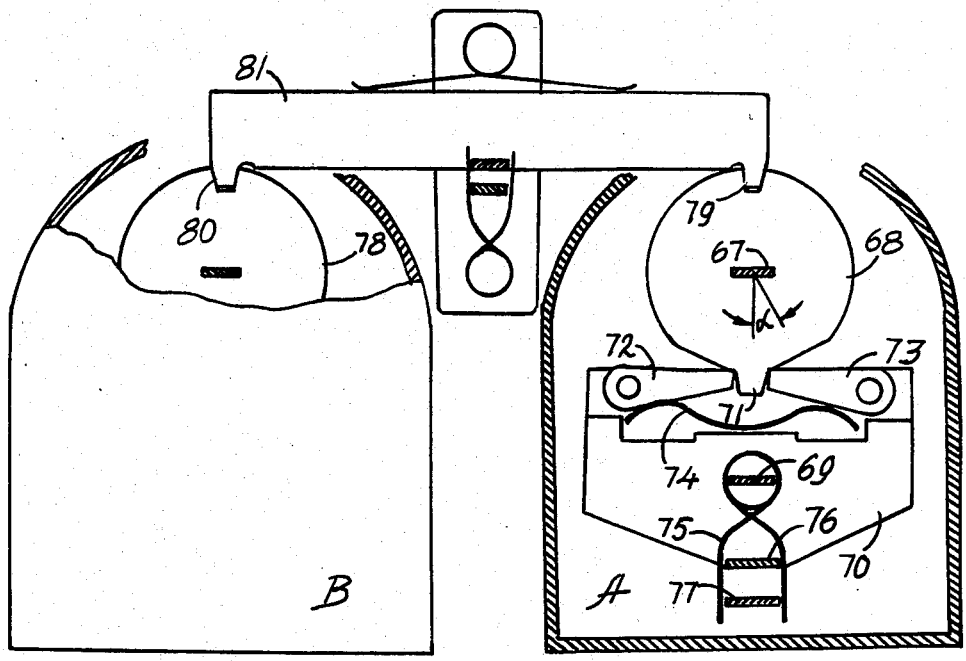
FIG. 7. A system for connecting the interdependent lock-cylinders in their initial positions by means of a disk and a rotating plate with pawls.

FIG. 7 shows a variant of a device, wherein each of locks A and B use two cylinders one of which is connected by the connecting bar 67 with the disk 68 and the second cylinder is connected by the connecting bar 69 with the plate 70. The disk 68 is provided with the extension 71, which interacts in the initial position of both cylinders A and B with two pawls 72 and 73 of the plate 70 which are pressed to the extension 71 by the spring 74. The rotation each of said cylinders from their initial positions is possible only if done together until the disk 68 is disengagement with the plate 70. When said plate 70 is released from the disk, then the plate 70 turned to its initial position by the spring 75 which supported by the stop 76 of the plate 70 and by the stop 77 of the locks plate. After this the disk 68 is rotated independently, and passes out one of the pawls 72 or 73 and take its initial position. The lock B is provided with a similar device. These disks 68 and 78 are provided with cavities 79 and 80 which are interact with extensions of the thrust bar 81 like it is showed in FIG. 3. This way, the unlocking each of the locks A or B is possible only when in their four cylinders are inserted right keys.

Figure 8:
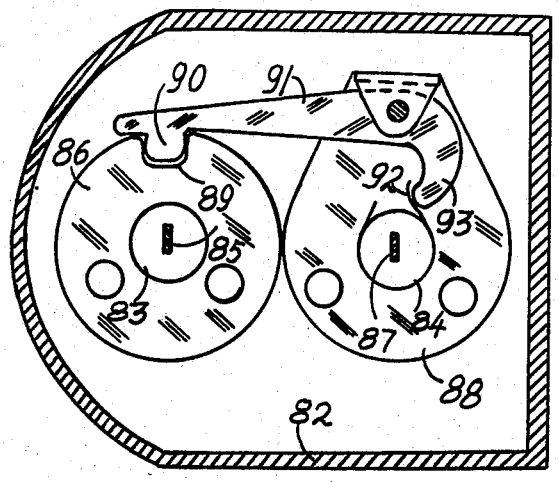
FIG. 8. A system for connecting the interdependent lock-cylinders in their initial positions by means of a disk and a lever.

FIG. 8 shows a variant of a device, wherein a standard lock 82 uses two cylinders 83 and 84, one of which is connected by the connecting bar 85 with the disk 86 and the second cylinder is connected by the connecting bar 87 with the disk 88. The disk 86 is provided with the notch 89 which interacts in the initial position of cylinder 83 with the tooth 90 of the lever 91 which is connected with the disk 88 and which is pressed to the disk 86 by means of spring 92 which rests in the projection 93 of the lever 91. Turning the disk 86 from the initial position of the cylinder 83 is possible only together with turning of the disk 88 from the initial position of the cylinder 84; after the disk 86 is released from the connection with the disk 88, it turns independently together with the cylinder 83 and resumes again its initial position. Subsequently the cylinder 84 with its disk 88 pushes out the lever 91 and turns in the opposite direction taking its initial position, and is stopped by means of the tooth 90 which locks the disk 86.

Figure 9:
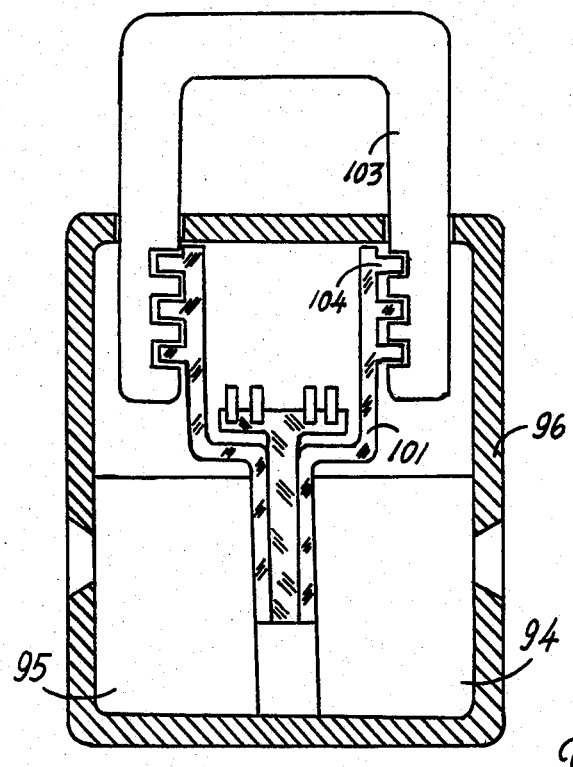
FIG. 9. A system for connecting the interdependent lock-cylinders for locking a padlock.
Figure 9:
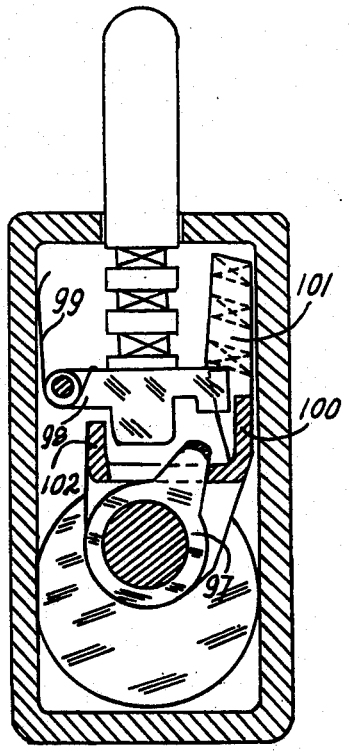

FIG. 9 shows a padlock wherein two cylinders 94 and 95 are coaxial fixed one with another by a bar and they are so placed opposite each other into the padlock 96, that their keys may be inserted in said cylinders only from opposite sides of the padlock. This connection provides the possibility of rotation each of said cylinders only together when into them are inserted right keys. The rotation these cylinders in common with the cam plate 97 cause the movement of the lever 98, which locks by the spring 99 the traverse 100 of the bolt 101. The pressing of the traverse 100 or 102 of the bolt 101 by the cam plate 97 causes the unlocking and locking the shackle 103 of the padlock by the projections 104.

Figure 10:
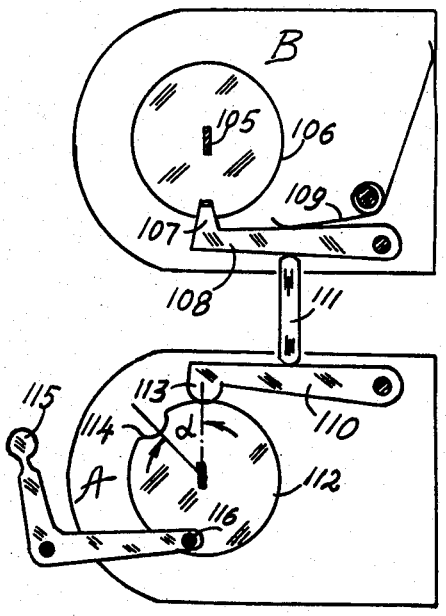
FIG. 10. A system for connecting a dependent lock-cylinder which is provided for being locked from inside the door.

FIG. 10 shows a variant of a device with two cylinders A and B, wherein the "dependent" cylinder B is connected by the connecting bar 105 with the disk 106 which is provided by a slot through which passes the connecting bar 105 of the lock. In the initial position of the connected cylinder this disk with said cylinder are locked by the cog 107 of the lever 108. The spring 109 presses the lever 110 by means of the lever 108 and thrust bar 111 to the disk 112 which is connected by a connecting bar with the "independent" cylinder A. When said cylinder A with the disk 112 are turned through a given predetermined angle x the projection 113 of the lever 110 come to rest in the cavity 114 of the disk 112; this releases of the disk 106 with the "dependent" cylinder B. The knob 115 is intended for locking the disk 112 with the cylinder A from inside the door, thus making it impossible to select the right keys to said cylinders when the disk 112 is closed by the projection 116 of the knob.

Figure 11:
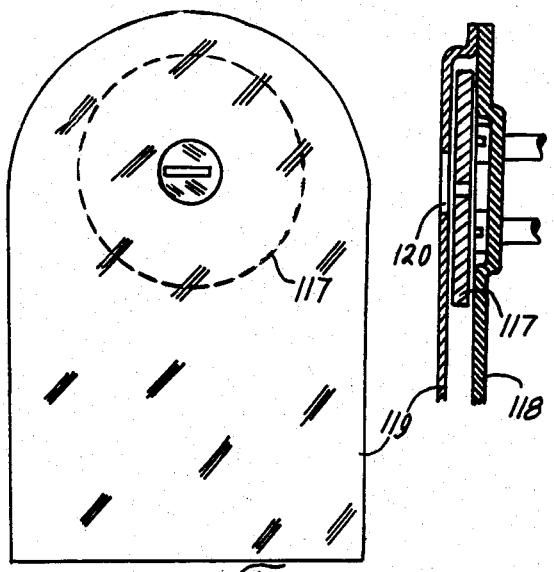
FIG. 11. A device which provides the use of its body for fixing the lock-cylinder to the door.

FIG. 11 shows a variant of the invention, wherein the disk 117, the lever and a spring such as spring 109 in FIG. 10 are mounted on the plate 118 which is also used for fixing the cylinder of the lock to the door, and said details are covered by the cover 119 which has hole 120 through which the connecting bar of the cylinder. Said cover 120 and the disk 117 are provided with holes through which screws can be inserted to fix the cylinder to the door. Such device in said cover placed between the door and each of the connected locks provides the possibility for connecting locks independent of the distance between them, and may be used with previously mounted locks.

Figure 12:
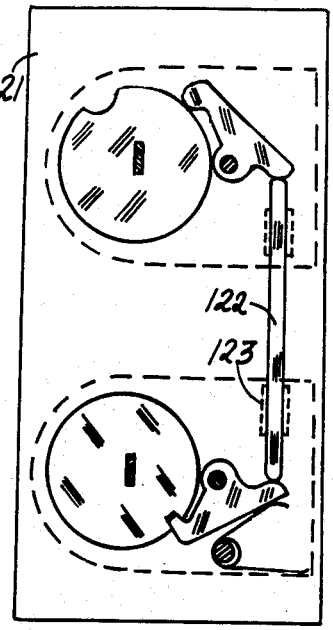
FIG. 12. A device of the system on which are mounted the connected locks.

FIG. 12 shows a variant of the invention, wherein two or more standard locks are mounted on the same plate 121 which is used also for fixing the cylinders of the locks to the door. The disks, levers and springs are covered by a cover as shown in FIG. 11. The thrust bar 122 slides along the guides 123 and said locks together with the plate 121 represents a special separate device for securing the door.

Figure 13:
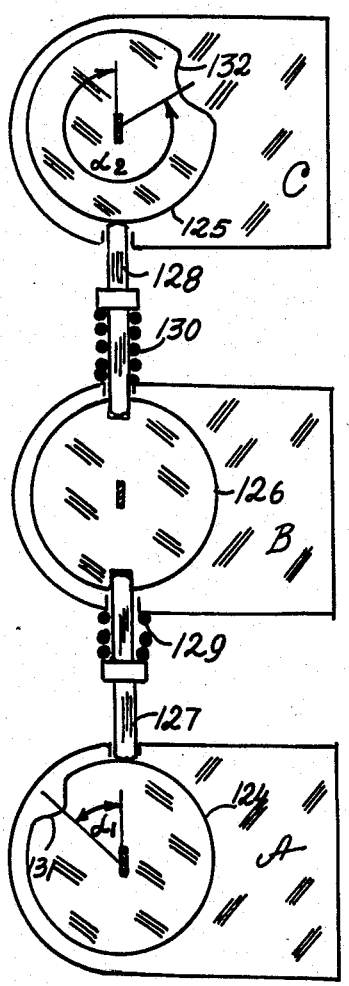
FIG. 13. A system of connection for three lock-cylinders wherein the middle cylinder is the dependent lock-cylinder which is released by means of a spring.

FIG. 13 shows a variant of a device, wherein the disks 124 and 125 are connected with the "independent" cylinders of the outer locks A and C, and the disk 126 is connected with the "dependent" cylinder of the middle lock B. In the initial positions of said cylinders A, B and C the disk 126 with the "dependent" cylinder are closed by the thrust bar 127 which rests on the disk 124 and by the thrust bar 128 which rests on the disk 125. For releasing the "dependent" cylinder it is necessary to rotate the "independent" cylinder A with the disk 124 through the given predetermined angle $x^1$ and the "independent" cylinder C with the disk 125 through the given predetermined angle $x^2$. Then said thrust bars 127 and 128 via the springs 129 and 130 come to rest in the cavities 131 and 132 of the disks 124 and 125 which release the disk 126 with the "dependent" cylinder B.

Figure 14:
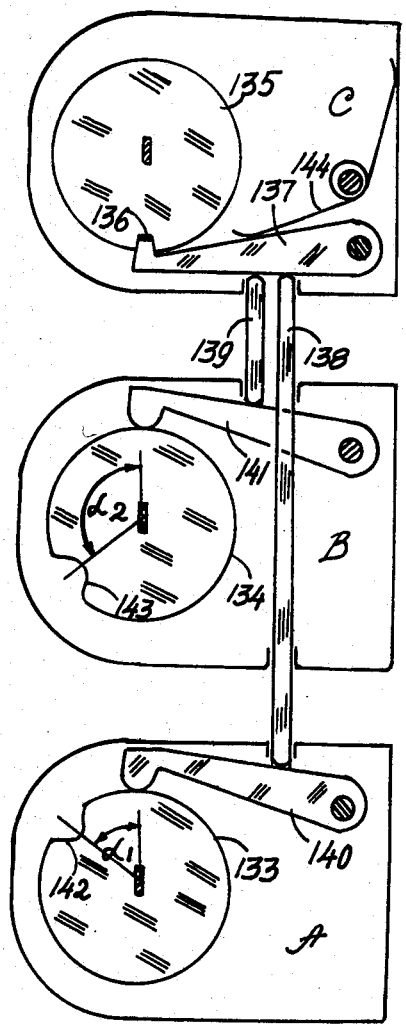
FIG. 14. A system of connection for three lock-cylinders wherein one of the outer cylinders is the dependent cylinder which is released by means of a spring.

FIG. 14 shows a variant of the invention, wherein the disks 133 and 134 are connected with the "independent" cylinders of the adjacent locks A and B, and the disk disk 135 is connected with the "dependent" cylinder of the outer lock C. In the initial positions of said cylinders A, B and C the disk 135 is closed by the cog 136 of the lever 137 which pressed by the thrust bars 138 and 139 and by the levers 140 and 141 on the disks 133 and 134. For releasing the "dependent" cylinder C it is necessary to rotate the disk 133 through an angle $x^1$ and the disk 134 through an angle $x^2$ when said levers 140 and 141 via the thrust bars 138 and 139 will come to rest in the cavities 142 and 143 of the disks 133 and 134 by means of the spring 144 which pushes the lever 137 out of the cavity of the disk 135.

Figure 15:
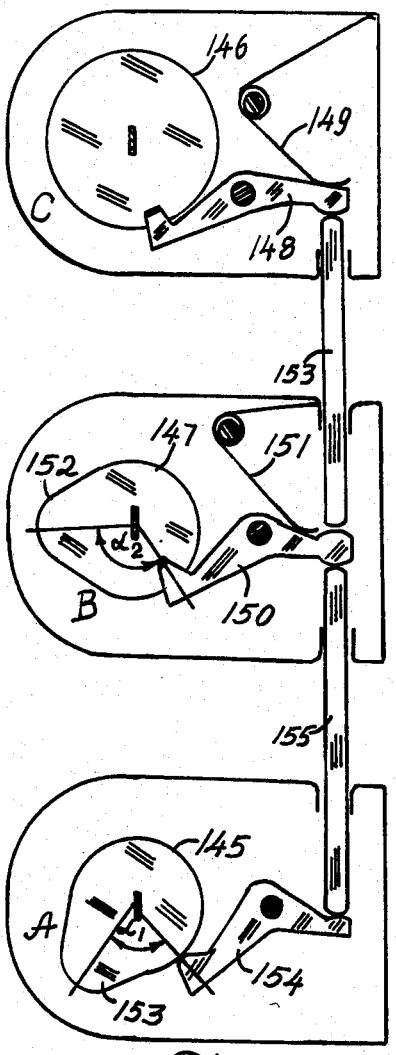
FIG. 15. A system of connecting three lock-cylinders wherein the dependent cylinder is released by a cam and locked by a spring.

FIG. 15 shows a variant of the invention, wherein the disk 145 is connected with the "independent" cylinder A, the disk 146 is connected with the "dependent" cylinder C, and the disk 147 is connected with the cylinder B, which is an a "dependent" cylinder relative to the cylinder A but is an "independent" cylinder relative to the cylinder C. In the initial position of said cylinders the disk 146 is closed by the lever 148 and the spring 149. The disk 147 is closed by the lever 150 and the spring 151. In order to release the disk 146 together with the "dependent" cylinder C it is necessary to turn the disk 147 through the angle $x^2$ upon which the cam 152 pushes out the lever 150 and via the thrust bar 153 pushes out the lever 148 from the cavity of the disk 146; but in order to rotate the disk 147 it is necessary first to release it from the lever 150, which closed it, and this requires rotating the disk 145 through said angle $x^1$ causing the cam 153 of the disk 145 to push out the lever 154 and via the the thrust bar 155 to push out the lever 150 which releases the disk 147.

Figure 16:
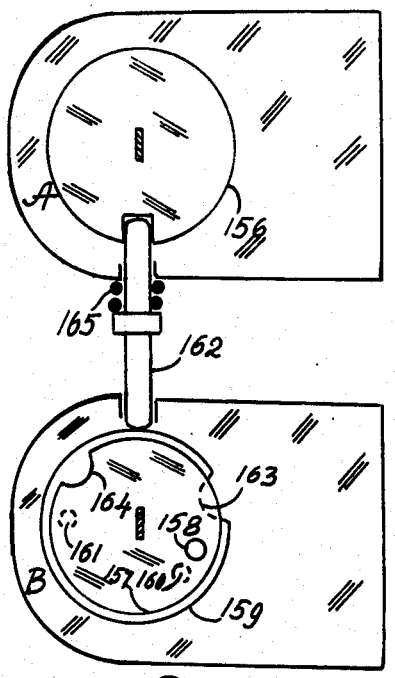
FIG. 16. A system for connecting two lock-cylinders wherein the dependent cylinder is released by means of rotating the independent cylinder through predetermined different angles.

FIG. 16 shows a variant of the invention, wherein the "dependent" cylinder A is connected by a connecting bar with the disk 156 and the "independent" cylinder B is connected by a connecting bar with the disk 157 which by means of its pin 158 moves the disk 159 by means of pushing its pins 160 and 161 which interact with the pin 158. For rotating the "dependent" cylinder A from its initial position it is necessary first to rotate the disk 157 in one direction through an angle of such magnitude that the thrust bar 162 comes to rest in a part of the cavity 163 of the disk 159. After that it is necessary to rotate the disk 157 in the opposite direction through an angle of such magnitude that its cavity 164 will coincide with the cavity 163 of the disk 159. This provides the transposition of the thrust bar 162 to the cavities 163 and 164 by means of the spring 165 thus releasing the disk 156 together with the "dependent" cylinder A.

Figure 17:
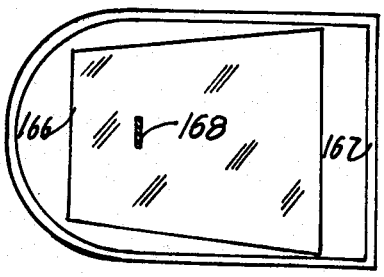
FIG. 17. A "dead" cylinder in the system of interconnected lock-cylinders.

FIG. 17 shows a variant of the invention, wherein the "dependent" cylinder is named a "dead" cylinder, because it is always closed. This is accomplished by means of plate 166 which rests on the body 167 of the lock and through the slot 168 of said plate is passed the connecting bar of the cylinder. Obviously locking of said cylinder may be accomplished by means of other ways which are known. Said lock may be used also as a bolt, which locks the door only from inside the door. This "dead" cylinder is intended for misleading the burglar (even if he knows this system) because he cannot know which of the interconnected cylinders is the "dependent" cylinder, which is the "independent" cylinder, and which is the "dead" cylinder. This way, finding the right keys for a system of interconnected cylinders which include a "dead" cylinder, is a waste of time.

I claim:

1. A locking system comprising a housing, first and second lock cylinders each including a disk having an extension, each of said disk being rotated by a suitable key, a thrust bar having notches to receive said extensions and having a locking position for which said extensions are engaged in said notches, said thrust bar being movable when said disks are rotated simultaneously so that said extensions move out of said notches, means to maintain said extensions in said notches when said thrust bar is in its locking position, and means to urge said thrust bar to its locking position.

2. The locking system of claim 1, wherein said means to maintain said extensions in said notches comprises springs.

3. The locking system of claim 1, wherein said means to urge said thrust bar to a given position comprises a spring.

* * * * *